US011313651B2

(12) United States Patent
Hadtke et al.

(10) Patent No.: US 11,313,651 B2
(45) Date of Patent: Apr. 26, 2022

(54) DEPLOYABLE BALLISTIC SHIELD

(71) Applicants: Frederick Borden Hadtke, Ocean City, NJ (US); Coert Hadtke Pease, Charlotte, NC (US)

(72) Inventors: Frederick Borden Hadtke, Ocean City, NJ (US); Coert Hadtke Pease, Charlotte, NC (US)

( * ) Notice: Subject to any disclaimer, the term of this patent is extended or adjusted under 35 U.S.C. 154(b) by 0 days.

(21) Appl. No.: 16/949,997

(22) Filed: Nov. 23, 2020

(65) Prior Publication Data

US 2021/0254934 A1 Aug. 19, 2021

Related U.S. Application Data

(60) Provisional application No. 62/939,338, filed on Nov. 22, 2019.

(51) Int. Cl.
*F41H 5/08* (2006.01)
*F41H 5/04* (2006.01)

(52) U.S. Cl.
CPC ..... *F41H 5/08* (2013.01); *F41H 5/0485* (2013.01)

(58) Field of Classification Search
CPC ..... F41H 5/08; F41H 5/0485
USPC ..... 89/36.02
See application file for complete search history.

(56) References Cited

U.S. PATENT DOCUMENTS 4,412,495 A 11/1983 Sankar
4,674,394 A 6/1987 Martino
5,022,307 A 6/1991 Gibbons, Jr. et al.
5,340,189 A 8/1994 Goodman
5,703,316 A * 12/1997 Madden, Jr. ..... F41H 5/16 296/1.07
5,756,922 A 5/1998 Fuller
6,581,505 B1 * 6/2003 Levell ..... F41H 5/08 182/129
6,647,855 B1 * 11/2003 Christiansen ..... B64G 1/56 89/36.01
6,807,890 B1 10/2004 Fuqua
7,124,675 B1 10/2006 Sand
7,493,844 B2 2/2009 Martin
8,043,982 B2 10/2011 Telander
8,375,839 B2 2/2013 Landi
8,408,114 B1 4/2013 Tan
8,418,595 B1 * 4/2013 Saucedo ..... F41H 5/26 89/36.07

(Continued)

FOREIGN PATENT DOCUMENTS

WO 9603613 A1 2/1996

*Primary Examiner* — Samir Abdosh
(74) *Attorney, Agent, or Firm* — Dunlap Bennett & Ludwig, PLLC; Brendan E. Squire

(57) ABSTRACT

A deployable ballistic shield is disclosed. The deployable ballistic shield includes a plurality of layers formed of a high impact anti-ballistic Aramid material. The shield is selectively configured between a stowed condition, in which the plurality of layers are in contact with an adjacent layer, and a deployed condition in which the plurality of layers are suspended in a spaced apart relation with a gap formed between the adjacent layer. A handhold is defined at a top end of the shield. Aa foothold may be defined at a bottom end of the shield. The deployable ballistic shield may be used by law enforcement, military, and other personnel as a protective ballistic barrier. Gaps between the plurality of layers serve to absorb the kinetic energy of a ballistic round.

19 Claims, 6 Drawing Sheets

(56) References Cited

U.S. PATENT DOCUMENTS

| | | | | |
|---|---|---|---|---|
| 8,646,372 | B1 | 2/2014 | Lee | |
| 8,857,310 | B2 | 10/2014 | Raiser | |
| 8,939,058 | B1 | 1/2015 | Ecalono | |
| 9,267,764 | B2 | 2/2016 | Seabrook | |
| 9,752,856 | B2 * | 9/2017 | Rashad | A01K 29/00 |
| 9,879,947 | B2 | 1/2018 | Van Heerden | |
| 10,113,360 | B2 * | 10/2018 | Hall | E06B 9/08 |
| 10,145,657 | B2 * | 12/2018 | Martinez | F41H 13/0018 |
| 10,267,601 | B1 * | 4/2019 | Beck | F41H 5/14 |
| 10,663,264 | B1 * | 5/2020 | Spradlin, Sr. | F41H 5/02 |
| 10,942,011 | B1 * | 3/2021 | Zea | E06B 9/80 |
| 10,976,138 | B2 * | 4/2021 | Tervola | F41H 5/08 |
| 10,996,027 | B2 * | 5/2021 | Gonzalez | F41H 5/08 |
| 2007/0149051 | A1 * | 6/2007 | Prock | F41H 3/00 439/607.01 |
| 2007/0295199 | A1 | 12/2007 | Elasic | |
| 2012/0180636 | A1 | 7/2012 | Seuk | |
| 2013/0276623 | A1 | 10/2013 | Moore et al. | |
| 2015/0233678 | A1 | 8/2015 | Smith | |
| 2015/0345913 | A1 | 12/2015 | Inglefield et al. | |
| 2016/0209181 | A1 * | 7/2016 | Adrain | E06B 9/386 |
| 2017/0074622 | A1 * | 3/2017 | Wallace | E06B 9/08 |
| 2019/0113312 | A1 * | 4/2019 | Adrain | B60J 1/2088 |
| 2020/0232767 | A1 * | 7/2020 | Riden | F41H 5/013 |
| 2020/0305566 | A1 * | 10/2020 | Taha | A45C 9/00 |
| 2020/0393217 | A1 * | 12/2020 | Adrain | B60J 1/2088 |
| 2021/0214675 | A1 * | 7/2021 | Kruger | C12N 1/20 |

* cited by examiner

DEPLOYABLE BALLISTIC SHIELD

CROSS-REFERENCE TO RELATED APPLICATION

This application claims the benefit of priority of U.S. provisional application No. 62/939,338, filed Nov. 22, 2019, the contents of which are herein incorporated by reference.

BACKGROUND OF THE INVENTION

The present invention relates to ballistic shields, and more particularly to deployable ballistic shields for individual protection.

Currently, law enforcement, private security and military users, when under attack, open the door to exit vehicle. They used the door to block incoming munitions. Metal doors are too thin to provide protection. Bullets passing through the door are often fragmented or deflected by internal door structures, so that the round breaks apart and tumbles. When striking the person in this twisting fashion the munition becomes more lethal.

Many times officers are wearing bulletproof vests for torso protection. Crouching behind the door exposes the lower legs from the shin down to the ground. This exposure is susceptible to submachine gun and hand gun munitions, particularly those that ricochet off the ground. Ricochet munitions typically reflect at an angle that parallels the ground. Vehicles with in-door, bullet proof barriers, as used in private security and government applications, exhibit the same shortcoming when the personnel exit the vehicle.

As can be seen, there is a need for portable shielding that removably attaches to a door and provides full body coverage from the head down to the ground.

SUMMARY OF THE INVENTION

In one aspect of the present invention, a deployable ballistic shield is disclosed. The deployable ballistic shield includes a shield having a plurality of layers formed of a high impact anti-ballistic Aramid material. The shield is selectively configured between a stowed condition, in which the plurality of layers are in contact with an adjacent layer, and a deployed condition in which the plurality of layers are suspended in a spaced apart relation with a gap formed between the adjacent layers. A handhold defined at a top end of the shield and a foothold defined at a bottom end of the shield.

In some embodiments, a graphene coating is provided on at least one of the plurality of layers. In other embodiments, a graphite layer is disposed between at least one of the adjacent layers.

In some embodiments, a sleeve is disposed along at least one of a top edge and a bottom edge of the shield. An elongate rod is received within the sleeve. The elongate rod extends laterally across one of the handhold or the foothold.

In some embodiments, one or more pivotable, articulated hinge sections are provided on the elongate rod that enable the shield to be pivoted and adjusted, at an angle of deployment preferred by a user. The one or more hinged sections enable a shape modification of the shield to provide both a lateral and a frontal protection barrier.

In some embodiments, a housing is configured to contain the shield when rolled in the stowed condition. The handhold is attached to the housing.

In other embodiments, a retraction assembly is carried within the housing. The retraction assembly is operable to move the shield between the deployed condition to the stowed condition.

In yet other embodiments, a plurality of alternating cooperating fasteners disposed in a spaced apart relation along lateral edge of an outer of the plurality of layers.

These and other features, aspects and advantages of the present invention will become better understood with reference to the following drawings, description and claims.

DETAILED DESCRIPTION

Figure 1:
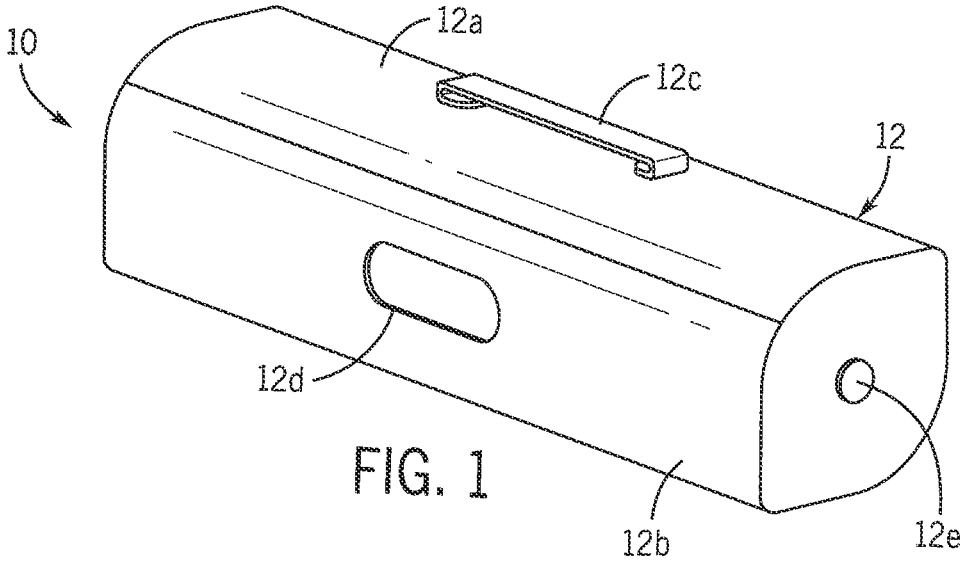
FIG. 1 is a perspective view of the invention in a closed position.
Figure 2:
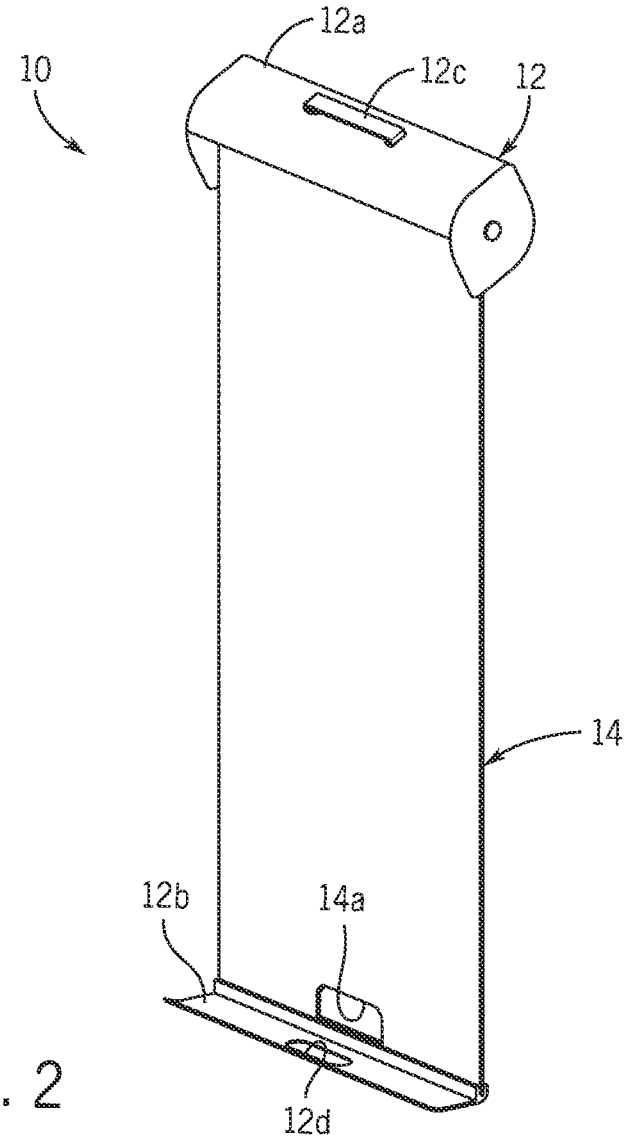
FIG. 2 is a perspective view of the invention in use in a deployed position.
Figure 3:
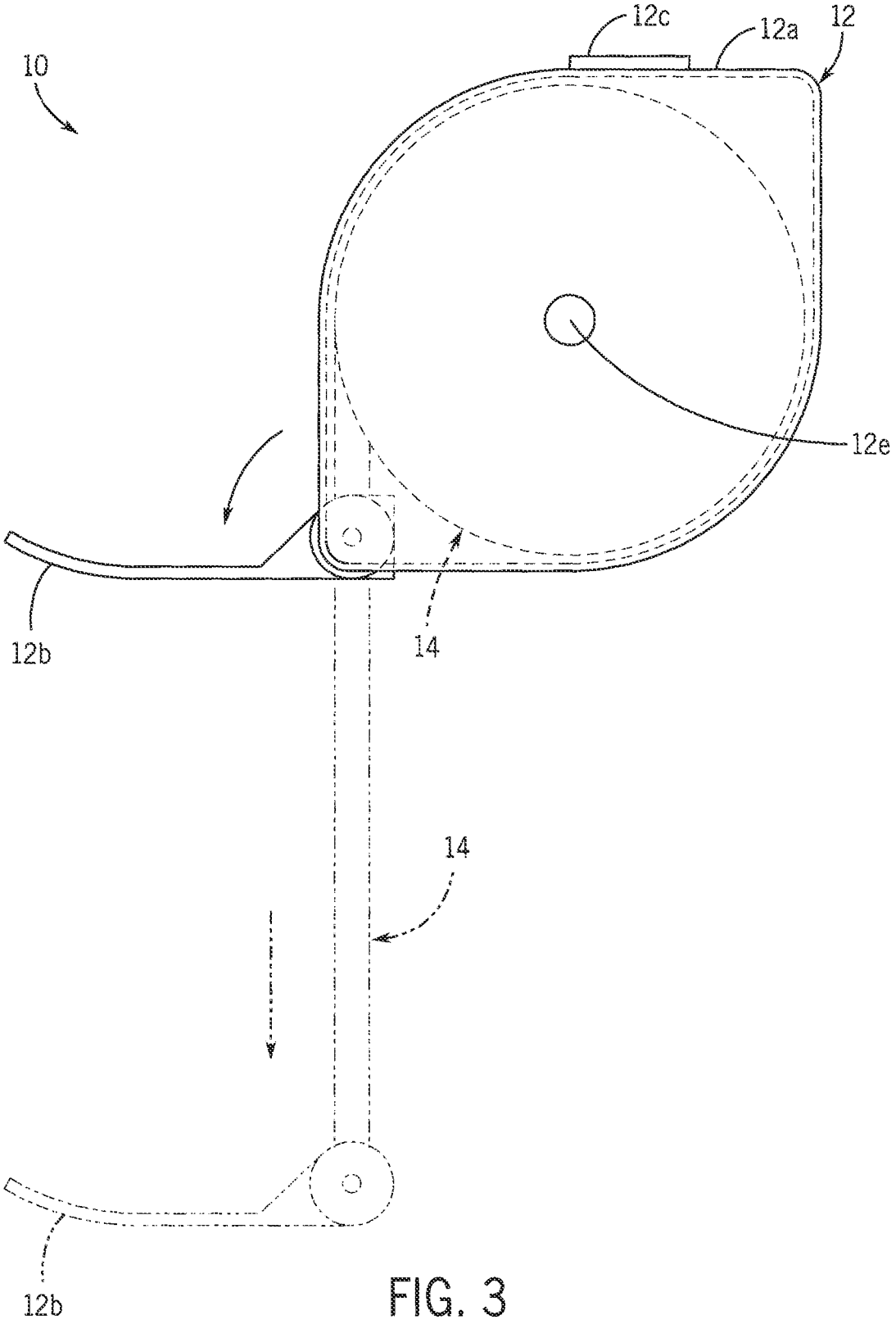
FIG. 3 is a side elevation view of the invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a deployable comprising: a flexible bullet resistant sheet; and a case, wherein the deployable ballistic shield comprises a stowed position and a deployed position, the stowed position comprising the flexible bullet resistant sheet rolled up and housed within the case; and the deployed position comprising the flexible bullet resistant sheet unrolled and disposed substantially outside the case.

The present invention, in several embodiments herein described, provides military, private security and law enforcement personnel with a light weight, portable, adaptable, easily deployed protective anti-ballistic shield when under attack from high velocity 9 mm submachine gun and pistol munitions. When attacked the user quickly deploys the shield for protection, such as when opening a vehicle's door. The portable shield extends from the top of the window frame down to the ground providing a full length protection and an effective barrier to incoming munitions when hiding behind the door. The multiple, flexible layers of anti-ballistic fabric (as an example Aramid "Kevlar" in its various grades)

provides a gapped layered armor effect when struck by projectiles, such as a bullet from 9 mm munitions. The shield's layers flex upon impact of a projectile helps it absorb the kinetic force.

The present invention provides law enforcement, private security and military personnel with a light weight, portable, adaptable and easily deployed shield to protect them when under attack from projectiles, such as high velocity 9 mm submachine gun and 9 mm pistol munitions. In one embodiment the shield may be removably attached to the frame of the door window and be quickly detachable for pursuing the culprit. To deploy the shield when under attack in other embodiments, the user unrolls or pulls down the multilayered shield, to protect the user when they open the vehicle's door. The door is not bullet proof and in fact sometimes causes the round to fragment and tumble making the munitions more lethal.

The shield's length extends from the top of the vehicle's window frame down to the ground to provide full length protection when exiting the vehicle. The shield with the door forms an effective barrier to incoming munitions. The shield is configured to stop high velocity, 9 mm submachine gun munitions from a distance of ten yards or greater. The shield would also be effective against close action weapons such as 9 mm handguns. These hand weapons, because of their lower muzzle velocity, would be more easily stopped even when encountered at a closer range.

The present invention utilizes layered armor. The shield is formed from a plurality of layers of a thin anti-ballistic fabric, some of the plurality of layers may be coated with graphene or may be replaced by graphite sheets or other light weight flexible materials. The plurality of layers are separated from each other forming a plurality of kinetic energy absorbing gaps. The plurality of layers of the shield can flex inward with the impact of the munitions.

The ballistic shield of the present invention is a multilayered assembly of anti-ballistic "Kevlar" fabric (Kevlar 29, K129, AP, KMZ) or multiple layers of a ballistic Aramid such as Nomex, Technora, Twaron or equivalent. The plurality of layers can be coated with graphene or replaced by graphite sheets or other laminations. In one embodiment an outer front and a back layer are alternately attached to inner layers that allow the structure to expand 50 mm (2") thick shield. The sides of the shield layers may not be attached. The layers are adhered at the top and bottom. When rolled into its storage form the inner layer forms hinges that let the surfaces to collapse from the approximately 2" deployed thickness to a one-layer thickness of approximately 5 mm (0.2"). Other embodiments the materials are loose and are simply rolled-up. Other embodiments have additional thicknesses of material attached to enhance protection.

The shield length may be approximately 1.37 m (54") has 7.4 turns to roll up into a 101 mm (4") diameter roll when using a ¾" to 1" core. The roll-up may be accomplished by either hand, a pull chain loop and sprocket, or an internal spring assembly like a window shade. In the closed condition the rolled shield, in some embodiments, is held by clips, snaps, straps or mounted to brackets attached to the window frame. In other embodiments the roll and deployment method is housed in a plastic or metal clam shell container composed of two or three parts. The top cover part has approximately a 25.4 mm (¾" to 1") hollow core fitted with a spring assembly or alternately at each end a cord-sprocket deployment and retraction assembly. The top part is securely attached to the window frame by any one of a number of mechanical means such as 3M DUAL LOCK™.

The attachment does not impede the opening of the door. The roll width can be adjusted to fit the vehicle. Shield assembly rotates away from the front side wall when the door is opened. This unique feature offers additional protection when deployed. When closed, the bottom housing engages the top housing part with forming a handle. Significantly the bottom part adds weight to keep the shield in constant contact with the ground. A step-on surface helps hold the shield on the ground to assure lower leg protection.

Referring now to FIGS. 1 through 13, the present invention includes a light weight, flexible, portable shield 10 to protect military, private security and law enforcement personnel when under attack from high velocity 9 mm machine gun and pistol munitions. The shield 14 is constructed from a plurality of layers 28 of a high impact anti-ballistic Aramid material such as "Kevlar". This material can be coated with graphene 31, or can use sheet graphite 33 or other combinations, laminations and materials that are suitably flexible and readily available in the marketplace.

The layered construction provides bullet stopping power and a degree of shock absorbing flexibility due to gaps 30 between each layer 28. Between two anti-ballistic "Kevlar" fabric layers, the inner and outer layers can be different grades of "Kevlar" or use a graphite layer or other materials coated with graphene. Graphene is 1000 times stronger that steel. In the embodiment shown in FIG. 4, The shield 14 is provided with cutouts 14*a*, 14*b* and a hand holding bars 18*b* at the top and a foothold 14*b* at the bottom. The rod 18*b* maintains the shield in the deployed position. The top cutout 14*a* and elongate rod 18*b* is configured to stabilize the user's weapon as they advance forward.

The assembly provides a highly portable shield 16 that protects the inside of the vehicle's door 26 and is portable enough to be advanced toward an assailant while maintaining frontal protection from incoming munitions. The flexible "Kevlar material 28", or other ballistic material compositions 31, 33 as described above, is easily rolled-up and quickly deployed. End caps 18*g* on the rod 18 secure the rod 18*b* within the shield loops 18*f* and can be configured to provide wind-up features and means of mounting the shield within the vehicle 26 using a variety of techniques such as clips or heavy-duty 3M DUAL LOCK™ attached by a high tack acrylic adhesive.

The shield is sewn, sealed, or adhered to form loops 18*f* to receive elongate rod 18*b* at the top and bottom. Loops can be configured to receive a ¾ or ⅝ inch steel, aluminum, fiberglass or wood rods. When deployed downward from the window frame mount the unrolled shield 18 provides ballistic protection when the door is used as a barrier. Military, private security and law enforcement personnel often hide behind the vehicle's open door 26*a* which is not bulletproof. Munitions passing through the door are deflected and tumble. The shield's multiple layers 28 create voids 30 that provide deflection to enhance the stopping power at the point of kinetic impact particularly for tumbling munitions that present a larger surface area to the shield layers.

Figure 5:
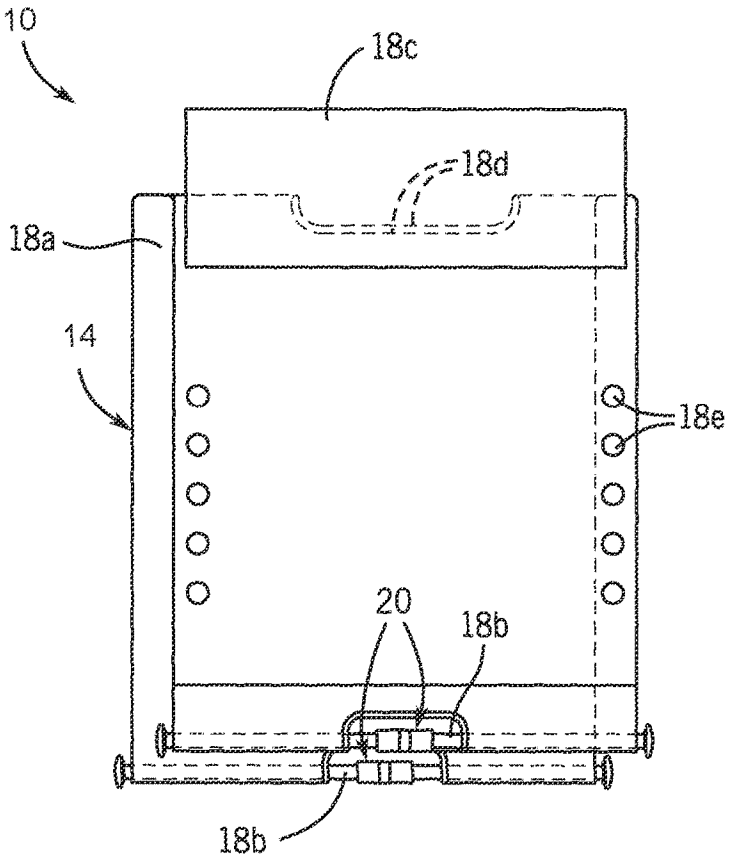
FIG. 5 is a front elevation view of the second configuration shown in the folded position.
Figure 4:
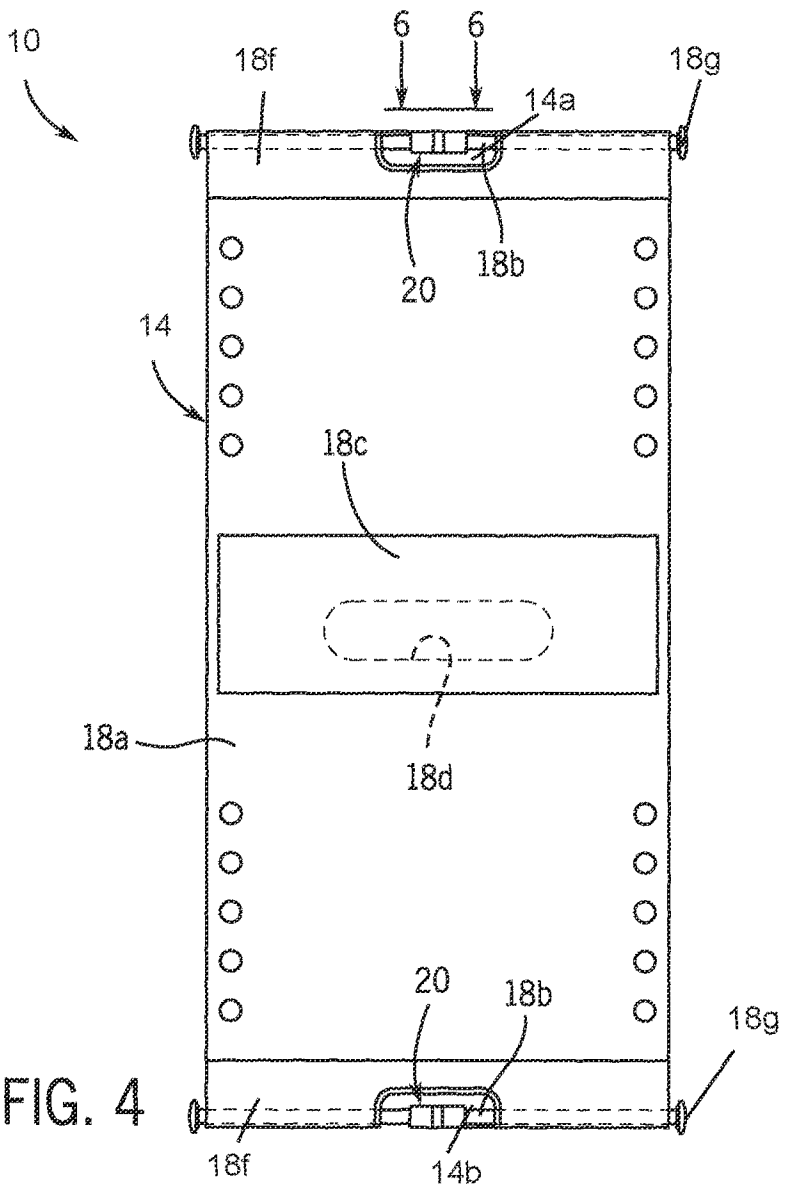
FIG. 4 is a front elevation view of a second configuration.
Figure 6:
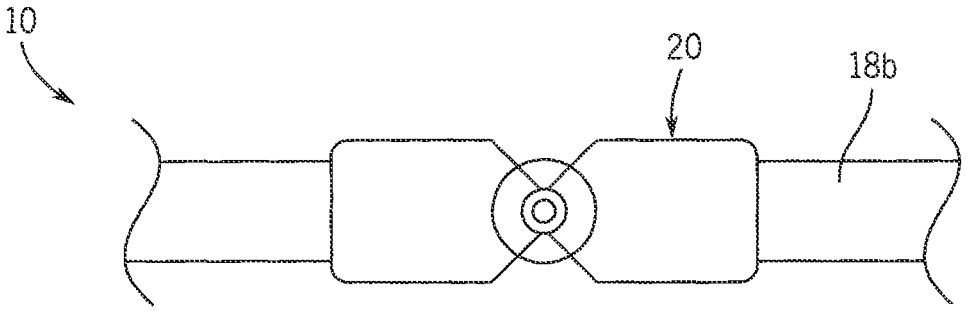
FIG. 6 is a detail view of the hinge taken on line 6-6 of FIG. 4.
Figure 7:
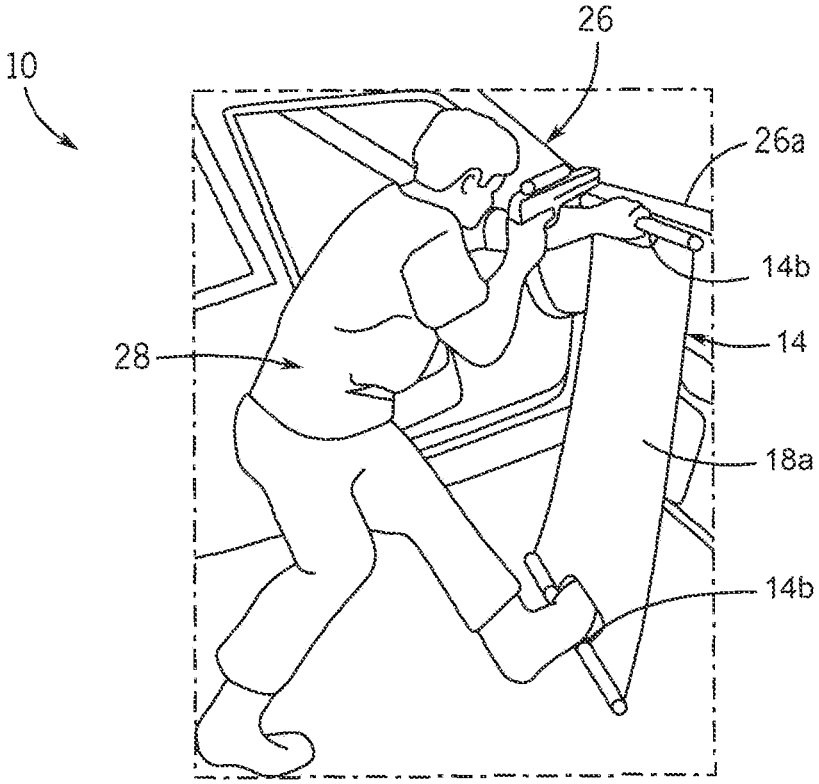
FIG. 7 is a perspective view of the invention in use in a third configuration.
Figure 8:
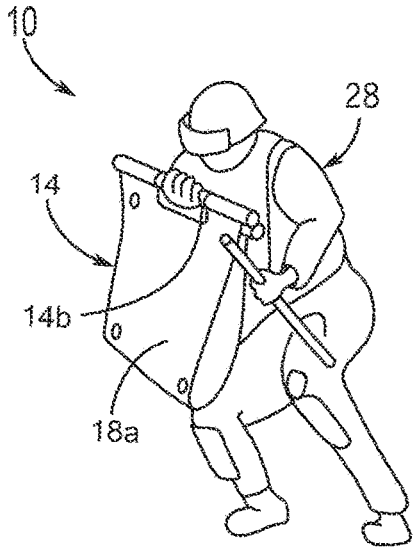
FIG. 8 is a perspective view of the invention in use in the third configuration in the folded shield mode.
Figure 9:
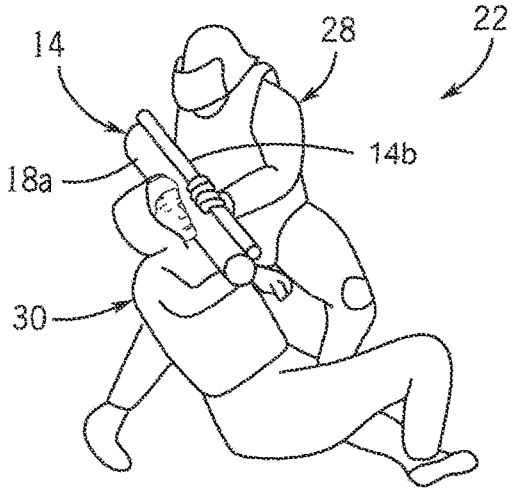
FIG. 9 is a perspective view of the invention in use in the third configuration in the rolled soft truncheon mode.
Figure 10:
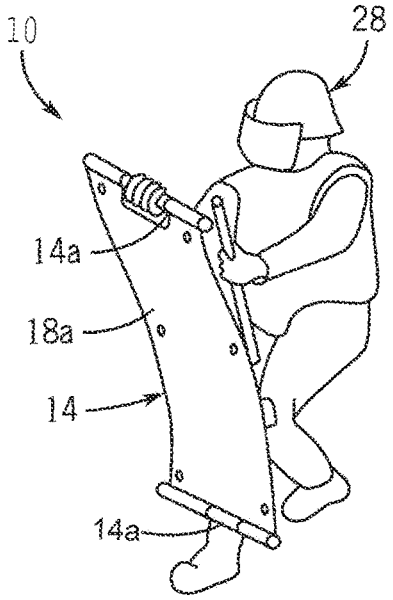
FIG. 10 is a perspective view of the invention in use in the third configuration in the full shield deployment mode.
Figure 11:
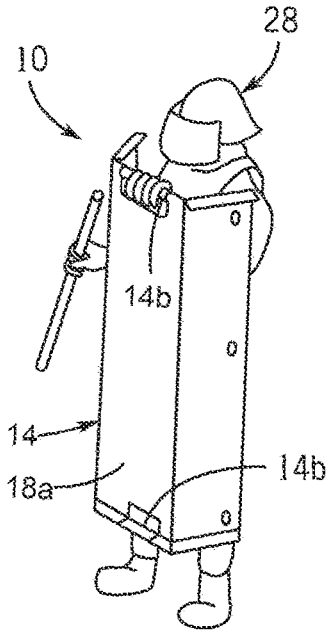
FIG. 11 is a perspective view of the invention in use in a fourth configuration.
Figure 12:
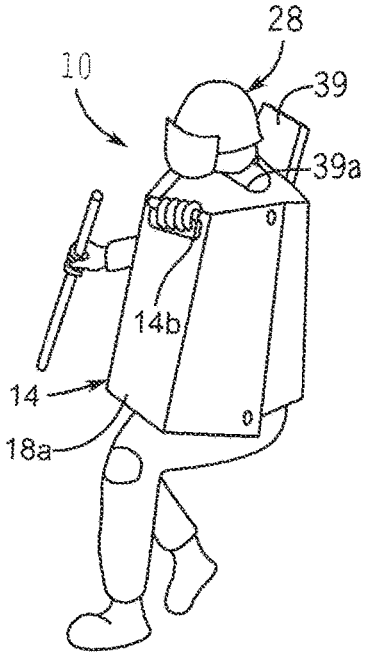
FIG. 12 is a perspective view of the invention in use in a fifth configuration.

The light weight, flexible and portable shield 10 of FIGS. 4-6 is used to protect military, private security and law enforcement personnel when under attack from high velocity 9 mm machine gun and pistol munitions. In this embodiment, the shield 14 may be provided with one or more pivotable, articulated hinge sections 20 on the holding rod 18*b* that enable the shield 10 to be pivoted and adjusted, at an angle of deployment preferred by the user. Hinged sections 20 enable shape modification of the shield 10 to provide both lateral and frontal protection. The angled shield 14 surface helps to deflect incoming munitions. The deflection enhances the protective aspect of the shield. One or more pivot points are positioned along the shield's hand cutouts 14*a*, 14*b*, and bars 18*b*, or near the hand cutouts 14*a*, 14*b*, using hinging devices readily available in the marketplace or easily produced. Stops can be included within the hinge to secure the shield at selected angles. End caps 18*g* on the rod 18*b* secure the rod within the sewn shield loops 18*f* and can be configured to provide other features.

The shield 10 may be provided with a number of alternating snaps 18*e* along each side and spaced apart to achieve a measured shortening of the shield. Snaps are mounted to the top layer 18*a* so that the other layers can flex. The snaps 18*e* enable the user to adapt the shield length for variations in stature of the user. Snaps 18*e* enable the shield 10 to be shortened to provide more protection where the user might need it, such as the torso. The snaps 18*e* or other mechanical means such as straps or Velcro Dots allow the shield 14 to be folded upward, as needed, providing more protection for the upper body. End caps 18*g* on rod 18*b* secure the elongate rod 18*b* within the sewn shield loops 18*f*.

The shield 10 may be provided with a series of gaps 30 between material layers 28 and 31, 33. The shield 10 is provided with a fenestration 18*d* that allows the shield to fit over the user's head when the shield is folded in half. A flap 18*c* sewn along the bottom edge covers the fenestration 18*d* when the shield 10 is used in the unfolded configuration to provide extra frontal protection of the torso and full length to the ground. Shield 10 when folded in half allows the head protrude through the fenestration 18*d*. The flap 18*c* remains in a vertical position to protect the user's neck when the shield is folded. At least one pivot attachment 20 is provided on hand holding elongate rod 18*b* located near hand cutouts. Pivot attachments 20 enable the "serape like" shield to be folded around the user forming front, back and side protection. Pivot attachments 20 provides one or more pivotable, articulated hinge sections on the holding rod 18*b* that enable the shield 10 to form a 360-degree protective "vest" shield 10 for full body protection.

The sides of the "vest" shield may be secured by alternating cooperating fasteners, such as snaps 18*e* or other mechanical means such as Velcro Dots, hooks or straps located along each side of the folded shield. Snaps 18*e* are mounted the outer layer so that the plurality of layers can maintain gaps and flex upon receiving a kinetic impact. This closure method creates a ballistic vest 10 freeing the user's hands for operation of weapons. The enclosed "serape or vest" shield 10 is made possible because of the half folding of the shield 14 and securing snaps 18*e*.

Figure 13:
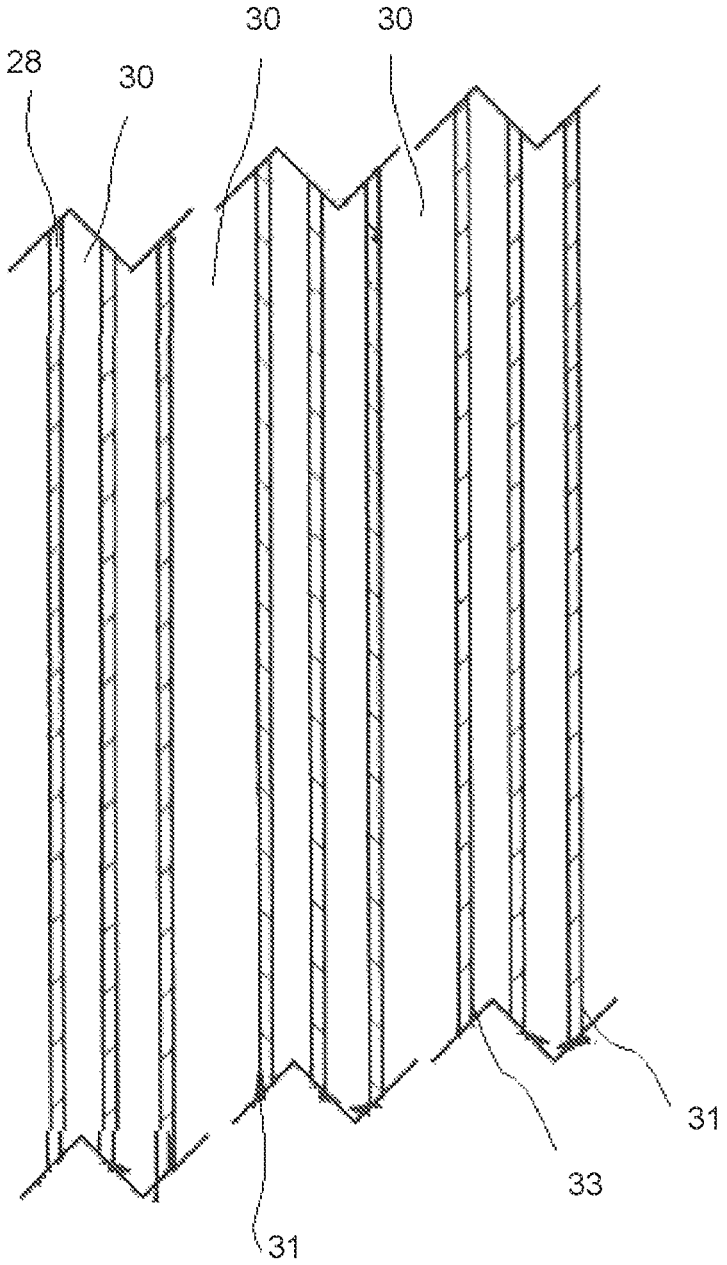
FIG. 13 is a side view of the plurality of layers in the deployed orientation.

Referring to FIG. 13, a wide variety of material types and grades of Kevlar 28 can be used including such materials as graphene coated fabrics 31, a sheet graphite 33 and other flexible laminations and materials readily available in the marketplace. Extra ballistic material layers enhance the shield's 14 resistance to penetration from high velocity munitions. The enhanced shield 14 is achieved by attaching one or more additional layers of ballistic material such as Kevlar, graphene coated fabrics, sheet graphite and other flexible laminations and materials readily available in the marketplace to the shield 14. Layers 28, 31, 33 can be attached by a variety of know methods including permanent stitching, removable hook and loop "Velcro", mechanical snaps, clips or straps. Layers 28, 31, 33 form additional gaps 30 between sheets. The removable feature enables the shield 14 to be easily customized before entering the field of conflict based on the type of threat.

Option 1 illustrates three sheets secured by stitching, hook and loop "Velcro", snaps, straps or other mechanical means along the top edges. End caps 18*g* on the elongate rod 18*b* secure the rod within the sewn shield loops 18*f* and can be configured to provide other wind-up features and means of mounting the rolled-up or fully deployed shield.

Additional sheets of multilayer, 3 ply material 28, 31, 33 form an arrangement with eleven impact absorbing spaces 30 or more between sheets. Gaps 30 offer additional protection by flexibly deflecting to absorb the kinetic energy of the munitions impact.

Option 2 uses an extruded part that forms one, two or three loops secured by aluminum, steel or solid wood or tubular rods held within the separating cross section features of the extrusion.

Slots enable loop ends to be slid into the extrusion and secured by rods separated by fins within the extrusion. The extrusion can be aluminum, coated steel, ABS, polycarbonate or HDPP or other rigid material. End caps configured to secure the rod in the shield loops snap onto ends of the extrusion and can be configured to provide other wind-up features and means of mounting the rolled-up or fully deployed shield. The extrusion increases the space between sheets.

Two more widely spaced gaps 30 are formed between 3 ply layers 28, 31, 33. This enhanced spacing allows the sheets of shield material 28, 31, 33 to flex at the moment of impact to absorb the force from munitions or projectiles. At the top of the ballistic shield 14 the layers could be sewn for a permanent arrangement or attached by "Velcro" or other removable means as described above for easy, quick adaptability. The sheets are left loose along the shield 14 sides and bottom portions of to allow for the individual sheets 28, 31, 33 to flex at the moment of impact to absorb more kinetic force from munitions or projectiles. The loose sheets 28, 31, 33 allow for wrinkle free roll-up of the shield to maintain compact storage.

The multilayer loop tail for and finished edges the top of the shield 14 enlarge the gaps between sheets for enhanced kinetic energy absorption. Use of "Velcro" or other mechanical means increases the gaps 30 and helps to enhance the absorption of the kinetic impact energy of Options 1 and 2.

The shield 14 may be compressed in one of a unique folding and/or roll-up of the ballistic shield 14 enables the shield 14 to be rapidly deployed in both the up and down directions when only the top half of the durable container, or housing 12 is pulled upward. The shield 14 is housed within the housing, which may be a three-part case 12 that can be affixed to the armrest area of the vehicle 26 using heavy-duty 3M DUAL LOCK™. The shield 14 is deployable with one upward motion that at the same time deploys the shield downward to cover the door down to the ground. The rolled shield 14 provides full length protection on the inside surface of the door 26 from the top window frame to the ground.

One exposed shield end 14 may securely attached to the top part 12*a* and one end to the bottom part 12*b*. The attachment means can be Velcro, 3M DUAL LOCK™, brackets or loop and rods or other secure attachment. The shield 14 is folded in half, or in any other proportion, then rolled up onto a core 12*e*, exposing both ends of the shield to the outside of the roll. As the shield 14 is deployed upward, the inner core spins to tighten the core's spring providing the energy required for rolling the shield 14 back into the housing 12. Securing cam style locking brackets at each end of the housing allow the core to hold its deployed position when the spring is empowered. The locking brackets can be hand twisted to tighten the spring in core. A quick upward movement may releases the cam to allow the shield to be automatically rewound on the outer core. This is a common method for the retraction of window shades. Parts 12*a* and 12*b* interlock using various techniques to form a unified, neat and portable package for storing or transporting the rolled shield 14. A carrying handle 12*c* is attached to the and is configured to provide flexibility for various hand sizes and gloves. The handle 12*c* is attached to the top of the housing 12 in such a way as to provide extra material at each end of the handle by an extended fold configuration. This package 12 may be secured within the vehicle 26 at the armrest area using heavy-duty 3M DUAL LOCK™. Alternatively, similar 3M DUAL LOCK™ strips may be adhered to the housing 12 to cooperatively snap into "Dual Lock" strips mounted to the window frame at the top of the door 26. Though primarily use to line the door 26 for protection, the shield 14 in container 12 easily detaches from the vehicle 26 to facilitate transport to another location or while chasing a person.

The present invention includes the ability to roll-up into a compact roll housed within a two part, snap together housing 12. In this embodiment the ballistic shield 14 can be attached the to the top of the vehicle's door window frame 26*a* using keyhole locks or hook and loop Velcro strips or heavy-duty 3M DUAL LOCK™. A rolled up ballistic material shield 14 housed in a durable, portable container 12 and allows for rapid deployment of the shield 14 by pulling downward as one would do with a window shade. The deployed shield 14 extends from the top of the door frame 26 to the ground.

The ballistic shield 14 provides full body protection on the inside surface of the door 26*a* when taking a protective position behind the door 26*a*. This is a typical defensive position when exiting the vehicle 26 to respond to an attacked. The shield 14 in this embodiment is housed within a two-part case 12 removably attached to the top window frame of the vehicle 26 using 3M "hook and loop" or heavy-duty 3M "Dual Lock" strips. As an alternative attachment method, keyhole slots could be molded or die cut into the back edge and engaging posts mounted to the upper door frame 26*a* securely attaches the shield assembly 10 to the door frame 26*c*. The keyhole attachment means allows the shield 10 to be easily disconnect from the window frame 26*a* when the user wants to pursue the felon.

It should be understood, of course, that the foregoing relates to exemplary embodiments of the invention and that modifications may be made without departing from the spirit and scope of the invention as set forth in the following claims.

What is claimed is:

1. A deployable ballistic shield, comprising:

a shield having a plurality of layers formed of a high impact anti-ballistic Aramid material, that is selectively configured between a stowed condition, in which the plurality of layers are in contact with an adjacent layer, and a deployed condition in which a majority of each of the plurality of layers are suspended in an overlapping spaced apart relation with a gap formed between the adjacent layer;

a handhold defined at a top end of the shield;

a foothold defined at a bottom end of the shield;

a sleeve disposed along at least one of a top edge and a bottom edge of the shield;

an elongate rod received within the sleeve, the elongate rod extending laterally across one of the handhold or the foothold.

2. The deployable ballistic shield of claim 1, further comprising:

a graphene coating on at least one of the plurality of layers.

3. The deployable ballistic shield of claim 1, further comprising:

a graphite layer disposed between at least one of the adjacent layers.

4. The deployable ballistic shield of claim 1, further comprising:

one or more pivotable, articulated hinge sections on the elongate rod enable the shield to be pivoted and adjusted, at an angle of deployment preferred by a user.

5. The deployable ballistic shield of claim 4, further comprising:

one or more hinged sections enable a shape modification of the shield to provide both a lateral and a frontal protection barrier.

6. The deployable ballistic shield of claim 1, further comprising:

a housing configured to contain the shield when rolled in the stowed condition.

7. The deployable ballistic shield of claim 6, wherein the handhold is attached to the housing.

8. The deployable ballistic shield of claim 6, further comprising:

a retraction assembly carried within the housing, the retraction assembly operable to move the shield between the deployed condition to the stowed condition.

9. The deployable ballistic shield of claim 6, further comprising:

a plurality of alternating cooperating fasteners disposed in a spaced apart relation along lateral edge of an outer of the plurality of layers.

10. A deployable ballistic shield, comprising:

a shield having a plurality of layers formed of a high impact anti-ballistic Aramid material, that is selectively configured between a stowed condition, in which the plurality of layers are in contact with an adjacent layer, and a deployed condition in which the plurality of layers are suspended in a spaced apart relation with a gap formed between the adjacent layer;

a handhold defined at a top end of the shield;

a foothold defined at a bottom end of the shield; and and a housing configured to contain the shield when rolled in the stowed condition.

11. The deployable ballistic shield of claim 10, wherein the handhold is attached to the housing.

12. The deployable ballistic shield of claim 10, further comprising:

a retraction assembly carried within the housing, the retraction assembly operable to move the shield between the deployed condition to the stowed condition.

13. The deployable ballistic shield of claim 10, further comprising:

a plurality of alternating cooperating fasteners disposed in a spaced apart relation along lateral edge of an outer of the plurality of layers.

14. The deployable ballistic shield of claim 10, further comprising:

a graphene coating on at least one of the plurality of layers.

15. The deployable ballistic shield of claim 10, further comprising:

a graphite layer disposed between at least one of the adjacent layers.

16. A deployable ballistic shield, comprising:

a shield having a plurality of layers formed of a high impact anti-ballistic Aramid material, that is selectively configured between a stowed condition, in which the plurality of layers are in contact with an adjacent layer, and a deployed condition in which the plurality of layers are suspended in a spaced apart relation with a gap formed between the adjacent layer, a graphite layer disposed between at least one of the adjacent layers;

a handhold defined at a top end of the shield; and a foothold defined at a bottom end of the shield.

17. The deployable ballistic shield of claim 16, further comprising;

a sleeve disposed along at least one of a top edge and a bottom edge of the shield; and an elongate rod received within the sleeve, the elongate rod extending laterally across one of the handhold or the foothold.

18. The deployable ballistic shield of claim 17, further comprising:

one or more pivotable, articulated hinge sections on the elongate rod enable the shield to be pivoted and adjusted, at an angle of deployment preferred by a user.

19. The deployable ballistic shield of claim 16, further comprising:

a housing configured to contain the shield when rolled in the stowed condition.

* * * * *